United States Patent [19]

Rothen et al.

[11] Patent Number: 5,000,112

[45] Date of Patent: Mar. 19, 1991

[54] APPARATUS FOR THE SURFACE COATING OF GLUE

[75] Inventors: Josef Rothen, Solingen; Wolfgang Meissner, Krefeld, both of Fed. Rep. of Germany

[73] Assignee: Macon Klebetechnik GmbH, Erkrath, Fed. Rep. of Germany

[21] Appl. No.: 311,916

[22] Filed: Feb. 17, 1989

[30] Foreign Application Priority Data

Feb. 17, 1988 [DE] Fed. Rep. of Germany ..... 3804856

[51] Int. Cl.[5] ..... B05C 3/02

[52] U.S. Cl. ..... 118/411; 118/410

[58] Field of Search ..... 118/410, 411, 419, 324; 222/255, 330

[56] References Cited

U.S. PATENT DOCUMENTS

| | | | |
|---|---|---|---|
| 2,765,962 | 10/1956 | Perkins | 222/255 |
| 4,265,377 | 5/1981 | Moen | 118/411 |
| 4,273,261 | 6/1981 | Krueger | 222/255 |
| 4,687,137 | 8/1987 | Boger et al. | 118/419 |
| 4,735,169 | 4/1988 | Cawston et al. | 118/411 |
| 4,774,109 | 9/1988 | Hadzimihalis | 118/411 |

FOREIGN PATENT DOCUMENTS

| | | |
|---|---|---|
| 96453 | 11/1989 | European Pat. Off. . |
| 3007031 | 9/1980 | Fed. Rep. of Germany . |
| 3200469 | 1/1985 | Fed. Rep. of Germany . |

*Primary Examiner*—Bernard Nozick

*Attorney, Agent, or Firm*—Foley & Lardner

[57] ABSTRACT

A glue coating apparatus is provided having a plurality of individual slit nozzles. Two faces are formed by an end face of a nozzle plate, in which feed channels open out, and by a clamping strip extending in front off the nozzle plate, these clamping a slit plate between them. The feed channels open into the regions of the slit plate which remain free between webs, so that the glue is channeled through the back of the slit plate. The webs and the individual glue streams are combined only immediately in front of an outflow point, to assure a uniform covering of the coating width, but prevent an overflow of glue from one slit nozzle into an adjacent one. The webs may also be tapered towards the outflow point, so that the individual glue streams can easily merge into one another. Separate glue pumps assigned to the individual slit nozzles can be provided in the form of a multiple pump, which can be designed as a gear pump, having a common central wheel and an appropriate number of planetary counter gear wheels arranged around the central wheel and generating cleanly separated feed streams.

2 Claims, 3 Drawing Sheets

APPARATUS FOR THE SURFACE COATING OF GLUE

BACKGROUND OF THE INVENTION

1. Field of the Invention

The invention relates to apparatuses for applying glue, and more particularly to an apparatus for applying glue to a heat sensitive, moisture proof film.

2. Discussion of the Related Art

Articles, such as baby diaper pants, diaper inserts, sanitary towels, patient underlays and operation dressings, which serve for absorbing fluid secreted from the body generally have on one side a fluid-impermeable, highly pliable film of small thickness, such as polypropylene, onto which is glued an absorbent surface pad composed of cellulose or a suitable plastic and covered by a nonwoven fleece-like material.

The absorbent pad is composed of a short-fiber wad of loose material which must be secured to the film, so that it maintains its position and does not slip during the handling of the article. Therefore, the absorbent pad must be adhesively bonded to the film.

This adhesive bonding process is difficult because the film which receives the glue is highly sensitive both mechanically and thermally. Prior attempts have been made to carry out the adhesive bonding by means of cold glue. However, cold glue is an aqueous dispersion, and, therefore, there may be problems with the possible inclusion of moisture when an absolutely leakproof final pack is desired.

The alternative is to use a hot-melt adhesive, but with this there are difficulties in achieving a uniform distribution of a small coating quantity over the coating width which is generally in the range of 200 to 800 mm. When coating is carried out with a single coating nozzle continuous over the coating width, considerable effort is involved in making the small quantity of glue flow out of the nozzle slit uniformly. In particular, a distribution which is to some extent uniform requires a low viscosity hot-melt adhesive which is applied at temperatures in the range of 110° to 140° C. Even under these conditions, the uniformity is unsatisfactory. The high temperature of the applied glue and the coating quantity (about 2–4 g/m$^2$), lead to a pronounced deformation of the film and irregular corrugations on the rear side of the hygiene article produced.

A further prior process comprises applying onto the film only individual narrow glue tracks laid next to one another at intervals. However, these glue tracks are likewise clearly pronounced on the rear side of the film. Also, between the glue tracks channels are formed, in which the absorbent pad is not connected to the film and through which fluid can escape.

SUMMARY OF THE INVENTION

The object of this invention is to provide an apparatus that can uniformly apply very small coating quantities per unit area over the width of an advancing substrate. A further object of this invention is to provide a glue coating apparatus having a plurality of individual glue pumps to assure uniformity over the width of the coated surface.

Another object of this invention is to provide a glue coating apparatus which can be easily adapted to coating surfaces of various widths.

Yet another object of this invention is to provide a glue coating apparatus wherein the amount of glue used can be minimized.

A further object of this invention is to provide a glue coating apparatus which will not have an adverse thermal effect on the underlying substrate.

A still further object of this invention is to provide a glue coating apparatus which can uniformly apply glue of high viscosity.

The foregoing objects are attained by providing a number of narrow slit nozzles next to one another, rather than a single wide nozzle. With a coating width of approximately 240 mm, for example, eight individual slit nozzles, each with a width of 30 mm, can be provided. Within an individual narrow slit nozzle, uniform distribution over the width is easily achieved. More important, however, is that these individual slit nozzles each have a particular glue pump and are not supplied from a common glue pump. This ensures that the same quantity of glue is always apportioned to each individual slit nozzle and distribution is correspondingly uniform over the entire coating width. For instance, if a slit nozzle is hydrodynamically preferred, for example because, as a result of production tolerances, it has a somewhat larger slit width or because the flow resistance of the channels up to the slit nozzle is somewhat lower, nevertheless only exactly the coating quantity apportioned by the pump assigned to this slit nozzle will flow out through it. In the prior art, if there were such a hydrodynamically preferred region in a slit nozzle that was continuous over the entire coating width, the coating quantity preferably flows out at this point and the pressure decreases sharply towards the sides, and hence differing coating quantities per unit area cannot be avoided.

A coating device with a plurality of adjacent units is disclosed in DE-PS 3,007,031. However, no slot nozzles are used out of which the coating liquid under pressure emerges. Rather, angular drain surfaces are disclosed over which the coating liquid drains off onto a path, thereby creating a strip-like coating. For higher viscosity coating substances, such as glue cement, this device is not suitable.

With regard to articles of hygiene in which the glue has to be coated onto a sensitive film, two important advantages are afforded by the present invention. Tests have shown that the coating quantity can be reduced to an amount of 0.2 g/m$^2$. Not only does this provide a glue savings, but also this has the effect that the thermal capacity of the glue coating is very low and, consequently, the thermal load on the substrate remains slight. Furthermore, in order to obtain a uniform coating, it is now no longer necessary, as it is with a prior continuous slit nozzle, to ensure that the viscosity of the glue is as low as possible. The coating is still uniform even when coating is carried out at a somewhat higher viscosity. This means that the temperature of the glue can be lowered to values of around 65° C. without loss of uniformity, the thermal load on the film also being reduced thereby.

Separate glue pumps assigned to the individual slit nozzles can be provided in the form of a multiple pump, which can be designed as a gear pump, having a common central wheel and an appropriate number of planetary counter gear wheels arranged around the central wheel and generating cleanly separated feed streams.

Two faces are formed by an end face of a nozzle plate, in which the feed channels open out, and by a clamping strip extending in front of the nozzle plate, these clamping the slit plate between them. The feed channels open into the regions of a slit plate which remain free between webs, so that the glue is channeled through the back of the slit plate. The webs and the individual glue streams are combined only immediately in front of an outflow point, to assure a uniform covering of the coating width, but prevent an overflow of glue from one slit nozzle into an adjacent one. The webs may also be tapered towards the outflow point, so that the individual glue streams can easily merge into one another.

In practice, the nozzle plate is generally a fixed component of the apparatus, so there is a predetermined distribution of the outflow mouths of the feed channels in the end face of the nozzle plate at specific distances from one another in the direction of the coating width. However, changing the coating width may be achieved by means of an intermediate plate, whereby the outflow points of the feed channels opening into the individual slit nozzles can be drawn apart from one another or crowded together. The slit plate and the intermediate plate are therefore exchanged in such a case, and thereby the work can be carried out with eight slit nozzles of a width of, for example, 35 mm instead of with eight slit nozzles, each of a width of 30 mm, without any assembly work other than the unscrewing of the clamping strip and the exchange the slit plate and intermediate plate being necessary.

Other objects and advantages of this invention will become apparent hereinafter in the specification and drawings which follow:

DETAILED DESCRIPTION OF THE PREFERRED EMBODIMENTS

Figure 1:
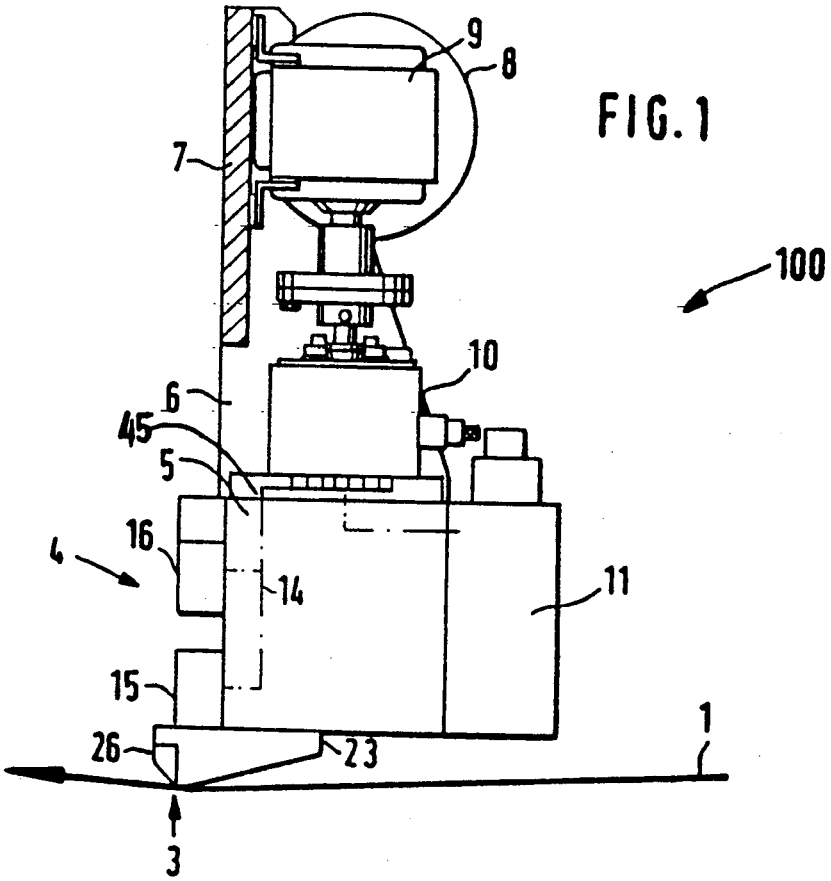
FIG. 1 is a side view of a glue applying apparatus according to the present invention.
Figure 2:
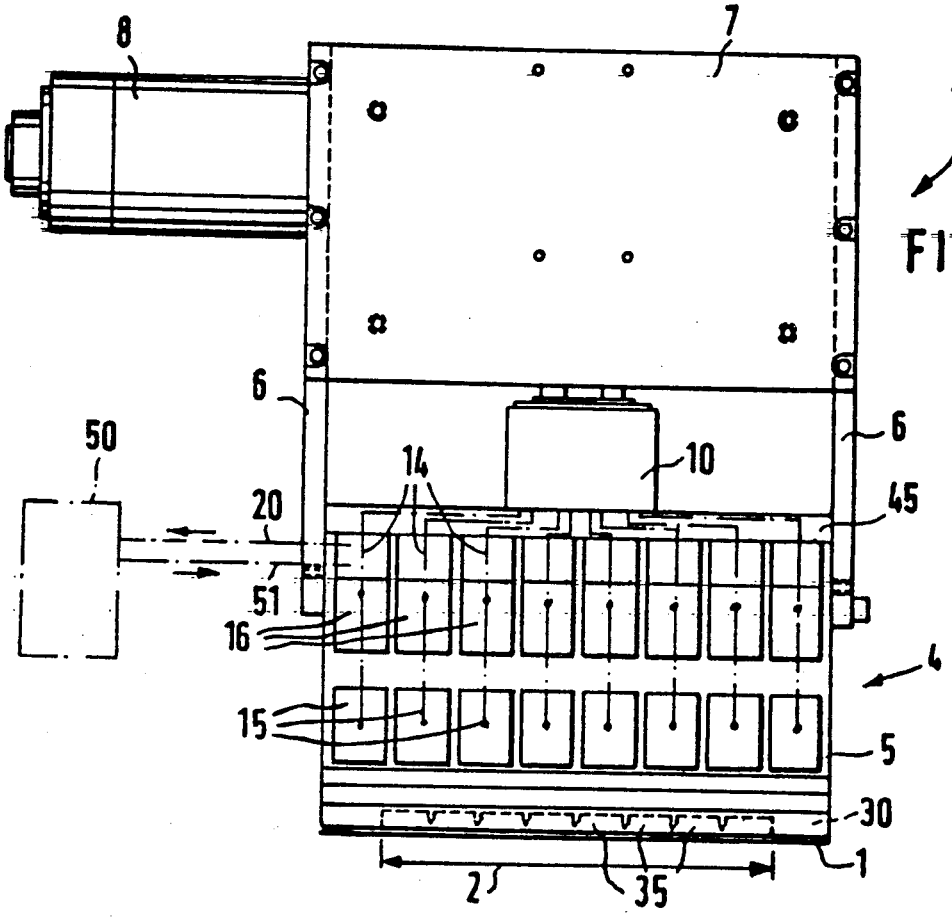
FIG. 2 is a left view of the apparatus of FIG. 1.

Referring to FIGS. 1 and 2, the glue applying apparatus 100 contemplates providing the surface of a film web 1 with a very thin layer of hot-melt adhesive uniformly over a coating width 2 (FIG. 2). In a preferred embodiment, the film web 1 is composed of polypropylene of a thickness of 15 My (micrometers) and is guided past an outflow point 3 of the hot-melt adhesive at a slight looping angle and with low longitudinal tension as illustrated in FIG. 1. The film web 1 is therefore unsupported at the outflow point 3.

Figure 3:
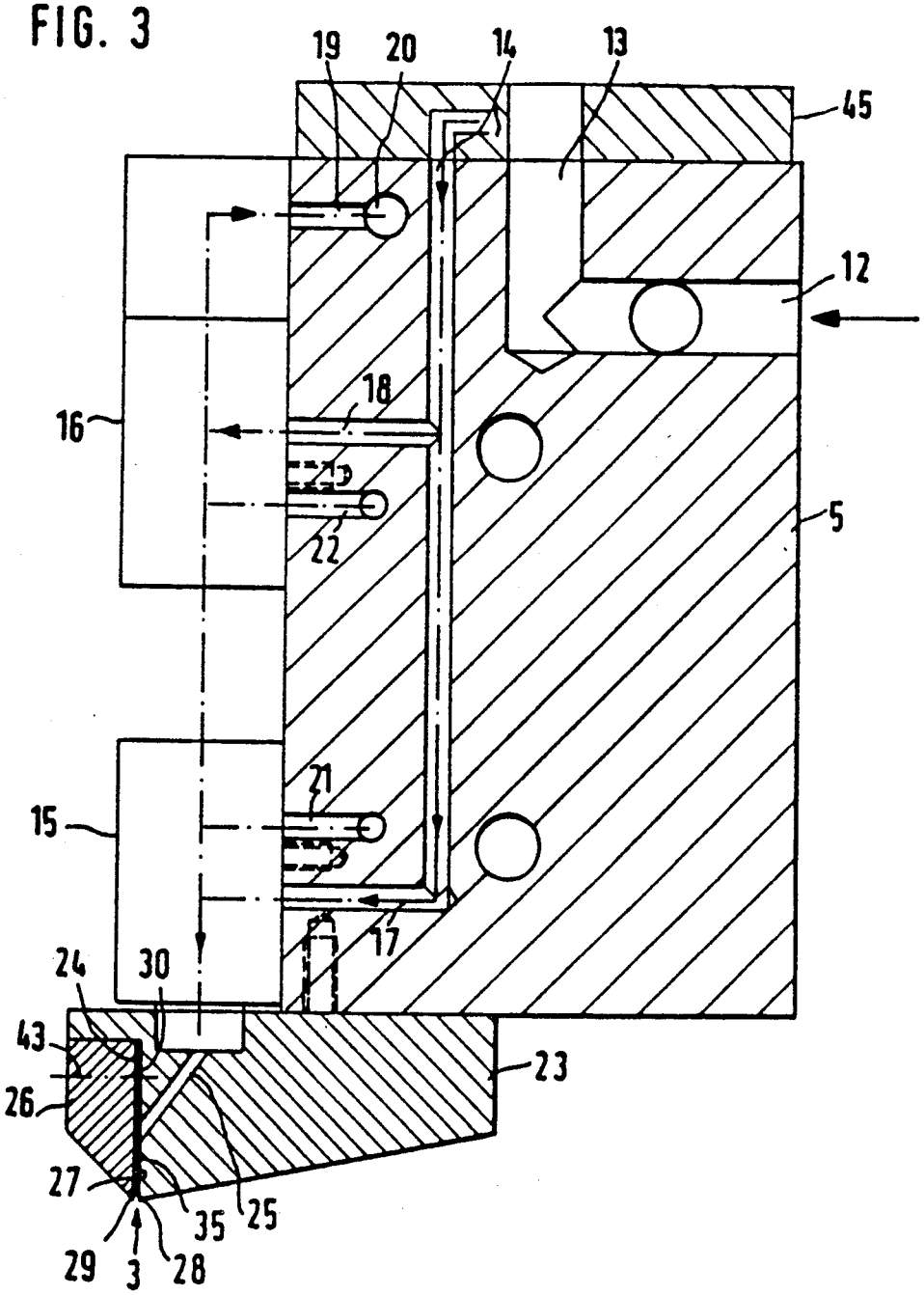
FIG. 3 is an enlarged partial section view of a portion of the glue applying apparatus of FIG. 1.
Figure 4:
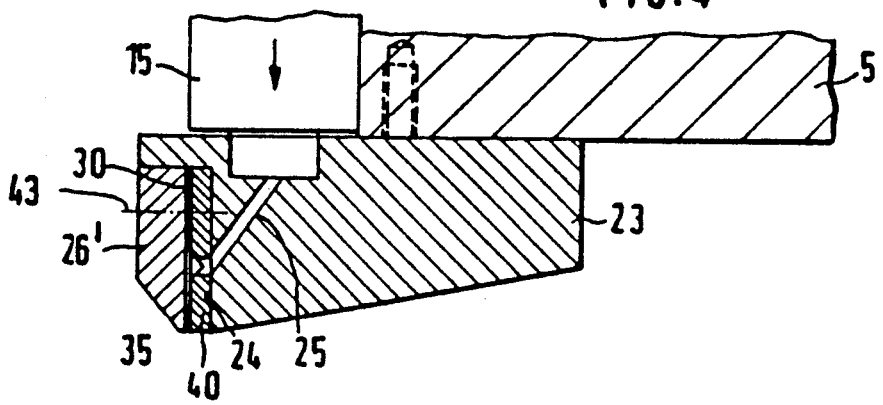
FIG. 4 is a lower part of the apparatus of FIG. 3 including an intermediate plate according to an embodiment of the present invention.

The apparatus 100 includes a coating head, designated generally by the reference numeral 4, having a coating block 5 with inner channels as shown in FIG. 3. The coating block 5 is held by two side cheeks 6 connected by means of a transverse plate 7 which is fastened above the film web 1 in a machine stand (not shown).

Secured to the transverse plate 7 is a drive motor 8 which, via an angular gear 9, drives an octuple gear pump 10 mounted on the coating block 5. The octuple gear pump 10 comprises eight individual gear pumps generating eight metered glue streams which are independent of one another and which are conveyed into the coating block 5 through inner channels. Liquid glue delivered from a melting device (not shown) passes through a filter 11, enters the coating block 5 at the channel 12 and at the mouth 13 overflows into the octuple gear pump 10 which feeds the glue, metered in eight independent streams, into eight channels 14 in the coating block 5 which are distributed over the width of the web. Assigned to each channel 14 is a coating valve 15 which is in communication with the channel 14 via a transverse channel 17. A cover plate 45 covers the distributing lines leading from the pumps 10 to the respective coating valves 15. Moreover, assigned to each channel 14 is a return-flow valve 16 which is arranged above the coating valve 15 and which is in communication with the channel 14 via a transverse channel 18. A glue return 20 is connected to the return-flow valve 16 via a transverse channel 19. The glue return 20 is connected to a storage container 50 which is, in turn, connected to glue delivering line 51.

The valves 15, 16 are of identical design in terms of their hydrodynamic resistance and may be controlled pneumatically. The air feed lines are designated by 21 and 22 respectively. Valves 15, 16 are always activated alternately. Thus, when the coating valve 15 closes, the return-flow valve 16 opens and allows the glue delivered by the pump 10 in the channel 14 to flow not via the transverse channel 17 to the coating valve 15, but via the transverse channel 18 to the return-flow valve 16 which is then opened and which conveys the glue further into the glue return 20. In this way, a glue flow of constant pressure, in which no pressure surges caused by the closing of the coating valve 15 occur, can be maintained in the channel 14 independently of the actuation of the coating valve 15. As shown in FIG. 2, eight pairs of valves 15, 16 are provided next to one another corresponding to the number of channels 14.

Figure 5:
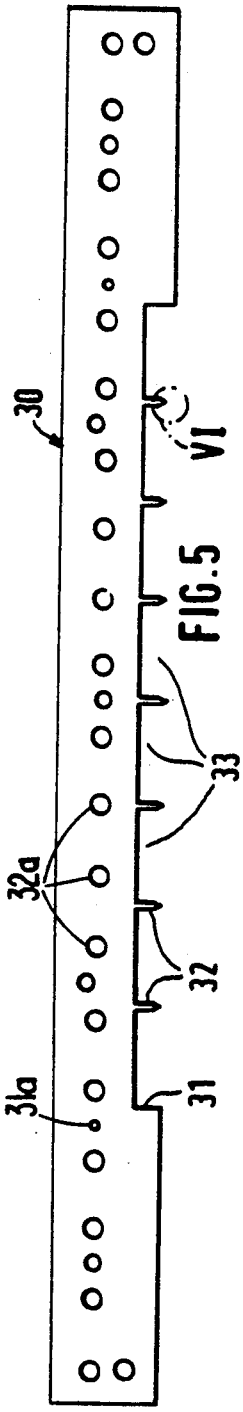
FIG. 5 is a view of a slit plate according to the present invention.

Referring now to FIG. 3, under the coating block 5 and the coating valve 15 is a nozzle plate 23, having an end face 24 which is vertical or extends essentially perpendicular relative to the substrate and in which there open eight glue channels 25 connecting with the respective outflow mouths of the coating valves 15. Arranged in front of the end face 24 is a slit plate 30, as shown in FIG. 5 which is screwed up against the end face 24 by means of a claping strip 26 with a plane rear side 27. The end face 24 and the rear side 27 have lower edges 28 and 29 located at the same height.

Figure 6:
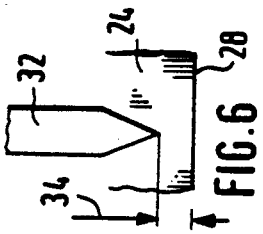
FIG. 6 is an enlarged representation of the region designated by VI in FIG. 5 and surrounded by a dot-and-dash circle.
Figure 8:
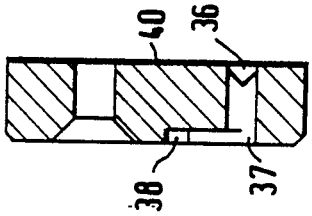
FIG. 8 is an enlarged section along the line VIII—VIII of FIG. 7.

Slit plate 30 covering end face 24 may be composed of brass or corrosion-proof steel and may have a thickness of about 0.3 mm. Formed on the underside is a rectangular cutout 31 (FIG. 5) which extends over the coating width 2 (FIG. 2) and which is subdivided into eight chambers 33 by means of seven equidistant webs 32 projecting into the cutout 31 like comb teeth. The webs 32 are approximately 1 mm wide and tapered at the front. The tip is at a short distance 34 (FIG. 6), for example 1 mm, above the lower edge 28 of the end face 24, when the slit plate 30 is mounted.

The chambers 33 are closed off on three sides, but are open at the bottom and, together with the faces 24 and 27, form slit nozzles 35 (FIG. 2) opening downwards and separated from one another. The slit plate 30 is positioned using pin holes 31*a* and clamped using screws 43 and screw holes 32*a*. Since the pressure in the device can become very high, many screws will typically be needed.

As illustrated in FIG. 2, the valves 15, 16 are arranged closely next to each other. Their width is essentially fixed, so that it is not possible to reduce the transverse distance between the glue channels 25. If the coating width 2 is calculated so that the division of the glue channels 25 corresponds to the division of the slit nozzles 35, the glue channels 25 can open directly into the slit nozzles 35 formed, as illustrated in FIG. 3.

However, if the division of the slit nozzles 35 does not correspond to the division of the channels 25 and the slit nozzles are narrower than the distances between the coating valves 15 (as in FIG. 2), the application width may be reduced by using an intermediate plate 40 as shown in FIGS. 4 and 7–10.

Figure 7:
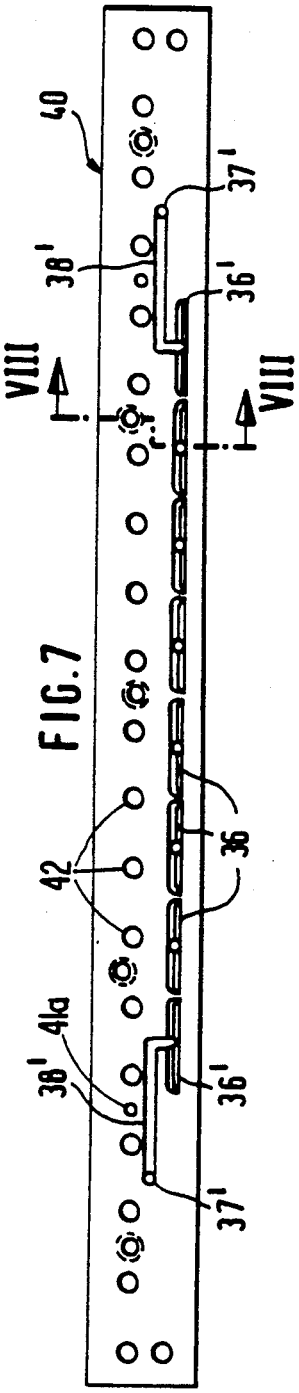
FIG. 7 is a left view of the intermediate plate of FIG. 4.
Figure 9:
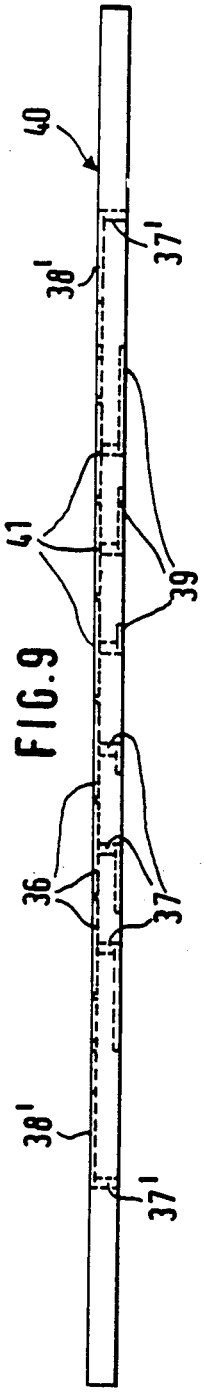
FIG. 9 is a top view of the intermediate plate of FIG. 7.
Figure 10:
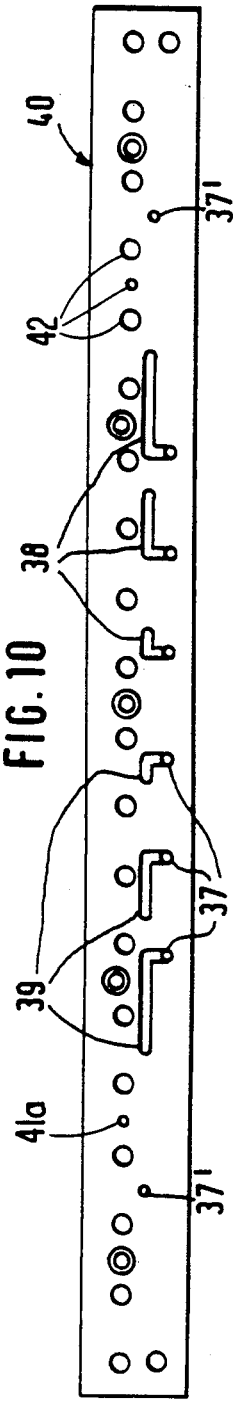
FIG. 10 is a rear view of the intermediate plate of FIG. 7.

The intermediate plate 40 has the same contour as the end face 24 and the slit plate 30. As shown in FIG. 7, there are spreading-out grooves 36, 36' which extend successively in the longitudinal direction of the intermediate plate 40, but are separated from one another and which correspond in length to the width of the chambers 33 of the slit plate 30. In the mounted state according to FIG. 4, the webs 32 extend at the points of interruption between successive spreading-out grooves 36, 36'. The middle six spreading-out grooves 36 have central passage bores 37 which extend to the rear side of the intermediate plate 40 as shown in FIG. 10. From the inlet mouths of the passage bores 37 on the rear side, angled channels 38 lead to the locations 39 which are opposite the outlet mouths of the glue channels 25 in the end face 24 of the nozzle plate 23. The locations 39 are at a distance from one another corresponding to that between the glue channels 25, whilst the passage bores 37 are at a distance from one another determined by the slit nozzles 35. With regard to the passage bores 37, leading to the two outer spreading-out grooves 36', for reasons of space the associated channel 38' is arranged on the front side of the intermediate plate 40 as shown in FIG. 7. The outlet mouths 41 of the passage bores 37 in the spreading-out grooves 36 are illustrated in FIG. 9. Pin holes 41*a* and screw holes 42 are similar to elements 31*a* and 32 of slit plate 30.

By inserting the intermediate plate 40, it is thus possible to change the division of the coating valves 15 or glue channels 25 which is predetermined on a specific apparatus 100 to another division, for example, to a narrower division for a smaller coating width 2, as shown in FIG. 2, but also to a wider division, if necessary.

To change the coating width, it is merely necessary to unscrew the clamping strip 26' and exchange the intermediate plate 40 and the slit plate 30.

It should become obvious to those skilled in the art that this invention is not limited to the preferred embodiments shown and described. For example, although the coating of the film with glue for the above-mentioned articles of hygiene is a preferred embodiment, clearly the apparatus may also be used for substrates other than the above-mentioned films, especially for the uniform coating of very small quantities of glue. Similarly, glue is merely the preferred use of the invention and other liquid to highly viscous coating media may also be applied to substrates with the apparatus according to the present invention.

What is claimed is:

1. An apparatus for continuously and uniformly applying a coating of a small quantity per unit area of a viscous substance to the surface of an advancing substrate, comprising:

a storage container for the coating substance;

a coating head having a plurality of adjacent identical slit nozzles disposed above said substrate and arranged transversely relative to the advancing direction of said substrate, said slit nozzles being separated from each other by a plurality of separating means extending toward said substrate, said separating means being located further from said substrate then a lower portion of said coating head;

a feeding device to guide said substrate directly beneath said slit-nozzle arrangement;

a separate metering pump for each slit nozzle for feeding the same quantity of the coating substance from the storage container only to the associated slit nozzle;

a coating substance outflow point located between a terminal end of said separating means and said lower portion of said coating head;

a slit plate clamped between first and second plane faces forming each of said slit nozzles, said plane faces having lower edges forming said lower portion of said coating head, said slit plate being integral with said separating means;

a plurality of channels fed by said metering pumps, said channels each being integral with said separating means; and an intermediate plate disposed between said first plane face and said slit plate, said intermediate plate having passage channels having a plurality of outlet mouths each leading into a corresponding slit nozzle.

2. The apparatus as claimed in claim 1, wherein the passage channels have passage bores extending perpendicular to the intermediate plate, and transverse grooves extending perpendicular to said passage bores provided on at least one side of said intermediate plate.

* * * * *